US007581316B2

(12) United States Patent
Grunow

(10) Patent No.: US 7,581,316 B2
(45) Date of Patent: Sep. 1, 2009

(54) VANE-TYPE CAMSHAFT ADJUSTER

(75) Inventor: Lutz Grunow, Berlin (DE)

(73) Assignee: Daimler AG, Stuttgart (DE)

( * ) Notice: Subject to any disclaimer, the term of this patent is extended or adjusted under 35 U.S.C. 154(b) by 0 days.

(21) Appl. No.: 11/711,166

(22) Filed: Feb. 26, 2007

(65) Prior Publication Data

US 2007/0234986 A1 Oct. 11, 2007

Related U.S. Application Data

(63) Continuation-in-part of application No. PCT/EP2005/009031, filed on Aug. 20, 2005.

(30) Foreign Application Priority Data

Aug. 27, 2004 (DE) ..... 10 2004 041 430

(51) Int. Cl.
*B21K 1/12* (2006.01)

(52) U.S. Cl. ..... 29/888.1; 123/90.15; 123/90.31

(58) Field of Classification Search ..... 123/90.15, 123/90.17, 90.31; 29/888.1, 888.08, 888.092, 29/428, 557; 72/274, 370.2, 370.25, 370.26
See application file for complete search history.

(56) References Cited

U.S. PATENT DOCUMENTS

| | | | | |
|---|---|---|---|---|
| 6,412,462 | B1 | 7/2002 | Lichti et al. | |
| 2003/0070639 | A1 * | 4/2003 | Kohrs | 123/90.17 |
| 2003/0217718 | A1 * | 11/2003 | Pierik et al. | 123/90.17 |

FOREIGN PATENT DOCUMENTS

| | | |
|---|---|---|
| DE | 198 17 319 | 10/1999 |
| DE | 199 55 507 | 6/2001 |
| DE | 199 51 391 | 7/2001 |
| DE | 101 48 687 | 6/2002 |
| EP | 1 544 419 | 6/2005 |
| EP | 1 544 420 | 6/2005 |
| JP | 2000 064814 A | 2/2000 |
| WO | WO 00/52308 | 9/2000 |

* cited by examiner

*Primary Examiner*—Zelalem Eshete
(74) *Attorney, Agent, or Firm*—Klaus J. Bach

(57) ABSTRACT

In a camshaft adjuster for an internal combustion engine including a housing, with two side cover sections and a middle jacket section arranged between the side cover sections and a rotor disposed in the housing, the jacket section is formed by a cross-cut profile section drawn from a tube in the form of a semi-finished product.

2 Claims, 1 Drawing Sheet

VANE-TYPE CAMSHAFT ADJUSTER

This is a Continuation-In-Part Application of pending International Patent Application PCT/EP2005/009031 filed Aug. 20, 2005 and claiming the priority of German Patent Application 10 2004 041 430.0 filed Aug. 27, 2004.

BACKGROUND OF THE INVENTION

The invention relates to a camshaft adjuster for an internal combustion engine comprising a housing with two side sections, a center section and a rotor mounted in the housing. The invention further relates to a method for manufacturing a housing for a camshaft adjuster for an internal combustion engine.

A camshaft adjuster of the generic type and a corresponding method for manufacturing the housing thereof are disclosed in DE 101 48 687 A1. Herein, the housing and/or the rotor are produced by the extrusion of an aluminum alloy.

Extrusion, however, is a relatively expensive method, which also has the disadvantage that it can be used with only a relatively limited number of materials.

Other camshaft adjusters and methods for their manufacture are described, for example, in DE 199 55 507 A1, DE 198 17 319 C2 or WO 00/52308 A1. The housings of these camshaft adjusters may take the form, for example, of sintered, forged or cast parts. In any event, also the cost of manufacturing these camshaft adjusters is relatively high. A further disadvantage of the known solutions is their generally very high weight of the components and in some cases the high cost of assembling the individual sections of the housing.

It is the object of the present invention to provide a camshaft adjuster for an internal combustion engine together with a method for manufacturing a housing for such a camshaft adjuster, which are simple and inexpensive while affording a high degree of reliability.

SUMMARY OF THE INVENTION

In a camshaft adjuster for an internal combustion engine including a housing, with two side cover sections and a middle jacket section arranged between the side cover sections and a rotor disposed in the housing, the jacket section is formed by a cross-cut profile section drawn from a tube in the form of a semi-finished product.

According to the invention the jacket section of the housing is formed by a cross-cut profile section drawn from a tube in the form of a semi-finished product, thereby producing an extremely lightweight housing for a camshaft adjuster. The method according to the invention is very easy to perform, the drawing process establishing an inside contour of the jacket section with a high dimensional accuracy and small surface roughness such that no further machining of the housing is necessary. After drawing, it is merely necessary to cross-cut the tube to the jacket section length required for the housing. All in all, therefore, this results in a very cost-effective camshaft adjuster.

A so-called vane rotor can be accommodated in the housing of the camshaft adjuster according to the invention, if the jacket section has at least two salient projections.

If, in addition, the two side sections are connected together by means of multiple fastening elements, both, the jacket section of the housing and the rotor arranged therebetween, can be designed irrespective of the fastening elements used to connect the two cover sections. The fastening elements may extend either outside or inside the jacket section.

An especially effective clamping of the two lateral cover sections and hence a correspondingly efficient sealing of the housing is achieved if in a further advantageous development of the invention the fastening elements are arranged immediately adjacent to the salient projections.

The invention will be explained in greater detail below on the basis of an exemplary embodiment described below schematically with reference to the accompanying drawings.

DESCRIPTION OF A PARTICULAR EMBODIMENT

Figure 1:
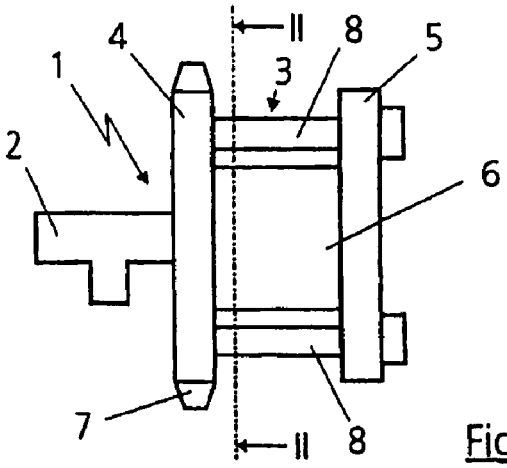
FIG. 1 is a side view of the camshaft adjuster according to the invention.

FIG. 1 shows a schematically a camshaft adjuster 1, which is intended for adjustment of the angle of rotation of a camshaft 2 in relation to a crankshaft (not shown) of an internal combustion engine (likewise not shown). The camshaft adjuster 1 may be embodied, for example, in a form such as is described in DE 199 55 507 A1 or DE 198 17 319 C2, and will therefore not be explained in any further detail. The camshaft adjuster 1 may be mounted to the camshaft 2 by means of a central bolt (not shown).

The camshaft adjuster 1 has a housing 3 with two side cover sections 4 and 5 and a middle jacket section 6 arranged between the side sections 4 and 5. The side section 4 facing the camshaft 2 is provided with a sprocket wheel 7, which allows the camshaft adjuster 1 to be incorporated into a chain drive of the internal combustion engine. The two side sections 4 and 5 are connected together by means of multiple fastening elements 8, here in the form of bolts, extending outside the jacket section 6, in order to seal the housing 3 tightly. The fastening elements 8 however might also extend inside the jacket section 6.

Figure 2:
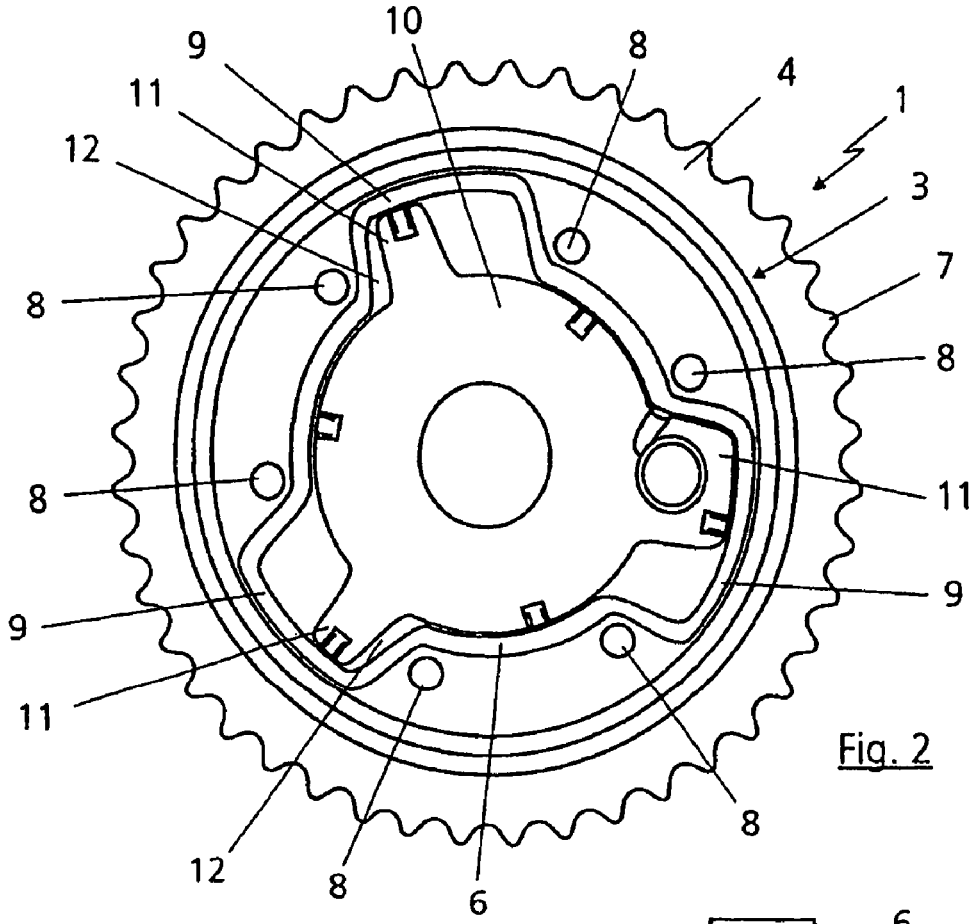
FIG. 2 is a sectional view taken along the line II-II in FIG. 1.

As will be clear from the representation according to FIG. 2, the jacket section 6 is of profiled cross section and in this case has three salient projections 9, making it suitable for the accommodation of a rotor 10 with three vanes 11 formed as a sintered or forged part, for example. The rotor 10 could also possibly have a different number of vanes 11, for example two or four. The jacket section 6 would then have to be provided with a corresponding number of salient projections 9. It can further be seen from FIG. 2 that at least one of the salient projections 9, in this case two, is formed in such a way that together with one of the vanes 11 of the rotor 10 it forms a chamber 12 for hydraulic fluid. Owing to the method for manufacturing the jacket section 6 described below, its wall in this area extends obliquely, that is to say at an angle in relation to the vane 11. In order to achieve the best possible sealing of the housing 3, the fastening elements 8 are in each case arranged immediately adjacent to the salient projections 9, two fastening elements 8 being associated with each salient projection 9.

The jacket section 6 is formed by a cross-cut profile section drawn from a tube 13 in the form of a semi-finished product. Here both a seamlessly drawn tube and a welded tube can be used as semi-finished product for the jacket section 6. Steel is preferably used as material for the tube 13, since this affords sufficient strength for a relatively small wall thickness and therefore permits a small overall size.

Figure 3:
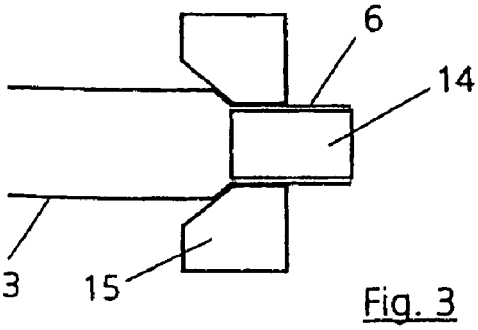
FIG. 3 shows a step in a method for manufacturing a housing for the camshaft adjuster according to the invention.

FIG. 3, in a highly schematic representation, shows the step in the manufacture of the jacket section 6 from the initially circular tube 13, the tube 13 being cold-drawn by means of a mandrel 14 arranged inside the tube and a die 15 surrounding the tube 13. The parting or cross-cutting of the jacket section 6, in order to obtain the desired length, can be done after drawing by laser cutting, water jet cutting, sawing, grinding or some other suitable machining method. If necessary, it is also possible to bring the jacket section 6 to the required length by an additional step in the method.

The invention claimed is:

1. A method for manufacturing a housing for a camshaft adjuster for an internal combustion engine, including two side sections (4, 5) connected to a middle jacket section (6) arranged between the side sections (4,5), said method comprising the steps of drawing a circular tube (13) through a die (15) to provide a tubular semi-finished product in the form of a jacket having at least two radially extending salient sections (9) forming chambers (12), cutting a jacket section (6) from the tubular semi-finished product to provide a jacket section (6), and mounting the jacket section (6) between the two side sections (4, 5).

2. The method as claimed in claim 1, wherein the circular tube (13) is cold-drawn through the die (15) with a mandrel (14) disposed in the die (15).

* * * * *